US005303785A

United States Patent [19]

Duke

[11] Patent Number: 5,303,785

[45] Date of Patent: Apr. 19, 1994

[54] DIAMOND BACK-UP FOR PDC CUTTERS

[75] Inventor: Donald R. Duke, Spring, Tex.

[73] Assignee: Smith International, Inc., Houston, Tex.

[21] Appl. No.: 934,978

[22] Filed: Aug. 25, 1992

[51] Int. Cl.[5] ..... E21B 10/52

[52] U.S. Cl. ..... 175/57; 175/470.2; 175/434; 76/108.2

[58] Field of Search ..... 175/57, 420.2, 434, 175/397; 76/108.2

[56] References Cited

U.S. PATENT DOCUMENTS 4,554,986 11/1985 Jones ..... 175/434 X
4,718,505 1/1988 Fuller ..... 175/329
4,889,017 12/1989 Fuller et al. ..... 76/108 A
4,991,670 2/1991 Fuller et al. ..... 175/329

*Primary Examiner*—William P. Neuder
*Attorney, Agent, or Firm*—Robert G. Upton

[57] ABSTRACT

A diamond drag bit is disclosed with a plurality of radially disposed raised rib portions formed in a cutting end of the bit body. One or more nozzles formed in the cutting end directs drilling fluid through the valleys formed by the ribs and over the ribs during operation of the bit in an earthen formation. Diamond cutters are strategically positioned in an outer face of the ribs. A multiplicity of diamond segments forming at least one flat surface thereon are strategically positioned and secured flush with the outer surface of the raised rib both rearwardly and laterally of each of the diamond cutters. The flush segments serve to protect a trailing edge of the raised ribs during drag bit operation.

8 Claims, 2 Drawing Sheets

DIAMOND BACK-UP FOR PDC CUTTERS

BACKGROUND OF THE INVENTION

I. Field of the Invention

The present invention is directed to drag bits having diamond or other hard cutter inserts. More specifically, this invention is directed to tungsten carbide matrix type blade drag bits incorporating polycrystalline diamond compact (PDC) cutters when drilling very elastic or plastic abrasive earthen formations. Under such conditions of drilling, the elastic rebound and/or plastic deformation of the rock being drilled causes the abrasive rock to bear on and wear away the bit face blade material circumferentially rearward of the PDC cutters mounted in sockets on the blades. When significant wear occurs, the PDC cutters have insufficient back support to maintain the cutters in place. It is an object of this invention to prevent or minimize the wear of the bit body material behind the PDC cutters to maintain the back support of the cutters thereby preventing catastrophic cutter loss and the subsequent termination of bit life.

II. Description of the Prior Art

There are a number of diamond drag bit patents that appear to be somewhat similar in construction to the present invention, but are designed to serve a different function.

For example, U.S. Pat. No. 4,718,505 describes a steel body drag bit having stud type polycrystalline diamond cutters (PDC) affixed to essentially radial raised rib portions of the bit cutting face with drilling fluid channels formed between the ribs. Spaced essentially rearward from each cutting element is a separate abrasion element comprising a cylindrical tungsten carbide stud impregnated at the lower end with diamond particles. This abrasion element is mounted in a socket on a raised portion of the bit cutting face and protrudes a significant amount from the rib outer surface, but a lesser amount than does the PDC cutting element. This abrading element may be located rearwardly behind the PDC cutter element on the same raised rib portion or on a separate rib with a fluid channel therebetween. This separate abrading element is intended to act as a back-up cutter in the event of the leading PDC cutter wear or breakage.

While bits built by the teaching of this patent have proven to be satisfactory in increasing bit life, the drilling rates are considerably slower when the abrading elements take over the drilling function because they are much less aggressive than sharp PDC cutters.

Another patent, U.S. Pat. No. 4,889,017, assigned to the same assignee as the foregoing patent, describes a polycrystalline diamond drag bit with the cutting head fabricated from a powdered tungsten carbide matrix material. The overall geometry of this bit type is essentially the same as described in the previous patent except for the method in which the abrading elements are formed. The tungsten carbide matrix head is cast in a refractory mold, such as graphite, by methods well known to those skilled in the art. The protruding abrading elements impregnated with diamond particles are formed as an integral part of finished cast cutting head. Bits made according to the teachings of this patent also offer additional bit life after the primary PDC cutters are worn out or broken, but the drilling rates are significantly slower than bits with intact primary cutters. Such bits also sustain breakage of the rearward edge of the raised rib with subsequent loss of primary PDC cutters because of the rearward tensile and shear forces imposed by the overturning movement of the protruding abrading element.

Still another patent, U.S. Pat. No. 4,991,670 is a Continuation-In-Part of U.S. Pat. No. 4,889,017, therefore the same advantages and disadvantages are applicable.

The present invention overcomes the shortcomings of the foregoing prior art patents by providing a single layer of diamond or other ultra-hard and abrasion resistant pieces imbedded in the tungsten carbide matrix ribs rearward of the PDC cutters. The ultra-hard pieces have at least one flat surface which is positioned with the flat surfaces flush with the outer surface of the bit body raised ribs. This provides an excellent wear or abrasion resistant surface having a very low coefficient of friction. Being flush set, the ultra-hard pieces do not engage the rock formations as cutting elements, therefore very low tensile and shear stresses are imposed on the rearward edge of the brittle raised ribs, thereby eliminating or minimizing wear and breakage of the trailing rib surface.

SUMMARY OF THE INVENTION

It is an object of the present invention to prevent or minimize the detrimental wear of the bit body rib material rearward of the polycrystalline diamond (PDC) cutters of a blade type PDC drag bit.

More specifically, it is an object of the present invention to provide a tungsten carbide matrix type drag bit that has essentially radial raised rib portions on the bit drilling end. A multiplicity of PDC cutters are fixedly attached to the ribs. The outer surfaces of the ribs rearward of the PDC cutters are protected from wear and breakage by flush mounted, essentially flat pieces of diamond or other super hard material immediately rearward, and to a certain extent, lateral to the PDC cutters.

A diamond drag bit is disclosed for drilling ductile or very elastic but very abrasive earthen formations. The drag type bit of the present invention consists of a bit body that forms a first pin end and a second cutting end. The first pin end is opened to a source of drilling fluid that is transmitted through an attachable drillstring. The pin end communicates with a fluid plenum chamber formed in the bit head. The drilling fluid is discharged from the plenum to the bit drilling face through nozzles or other appropriate orifices. The fluid is thence directed essentially radially across the drilling face through channels formed by alternating raised rib portions of the bit head to cool and clean the cutters and the bit cutting end. A multiplicity of polycrystalline diamond cutters (PDC) are strategically positioned and fixedly attached in preformed sockets formed by the raised rib portions. Pieces of diamond or other ultra-hard material, which have at least one flat surface, are imbedded in the tungsten carbide matrix ribs when the bit head is cast. The bit head is cast by methods well known to those skilled in the art of powdered metallurgy. The pieces of diamond or other ultra-hard material are positioned with the aforementioned flat surfaces flush with the outer rib surfaces both rearward and somewhat lateral to the PDC cutters.

A diamond drag bit for drilling a borehole in an earthen formation consists of a bit body forming a first open pin end that is adapted to be connected to a drill string and a second cutter end. The bit body forms a plenum chamber therein for receiving a source of drilling fluid transported through the drill string. One or more nozzles is formed by the cutter end of the body. The nozzles communicate with the plenum chamber and directs the fluid from the chamber to the borehole.

A face of the second cutter end forms a plurality of radially extended ribbed portions and valleys between the ribbed portions. A portion of the fluid being directed through the valleys and over the ribbed portions during operation of the drag bit in the earthen formation.

A multiplicity of diamond cutters are strategically positioned and fixedly attached on an outer face of the raised rib portions. The cutters are retained in preformed sockets formed by the raised rib portions.

A multiplicity of ultra-hard material segments having at least one flat surface are imbedded in the raised rib portion. The segments of hard material are strategically positioned both rearwardly and laterally of each of the diamond cutters. Each of the segments are fixedly secured with their flat surface substantially flush with the raised rib portion. The multiplicity of ultra-hard material segments serve to protect a trailing edge of the raised ribs from abrading thereby minimizing cutter loss.

An advantage then of the present invention over the prior art is the wear or abrasion resistant surfaces afforded by the flush mounted flat diamond or other ultra-hard material effectively protect the trailing edges of the ribs from abrading or wearing away, thereby minimizing PDC cutter loss.

Yet another advantage of the present invention over the prior art is that the flush mounted flat diamond surfaces have a very low coefficient of friction that minimizes heat build up that would otherwise further weaken the already brittle tungsten carbide matrix ribs.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
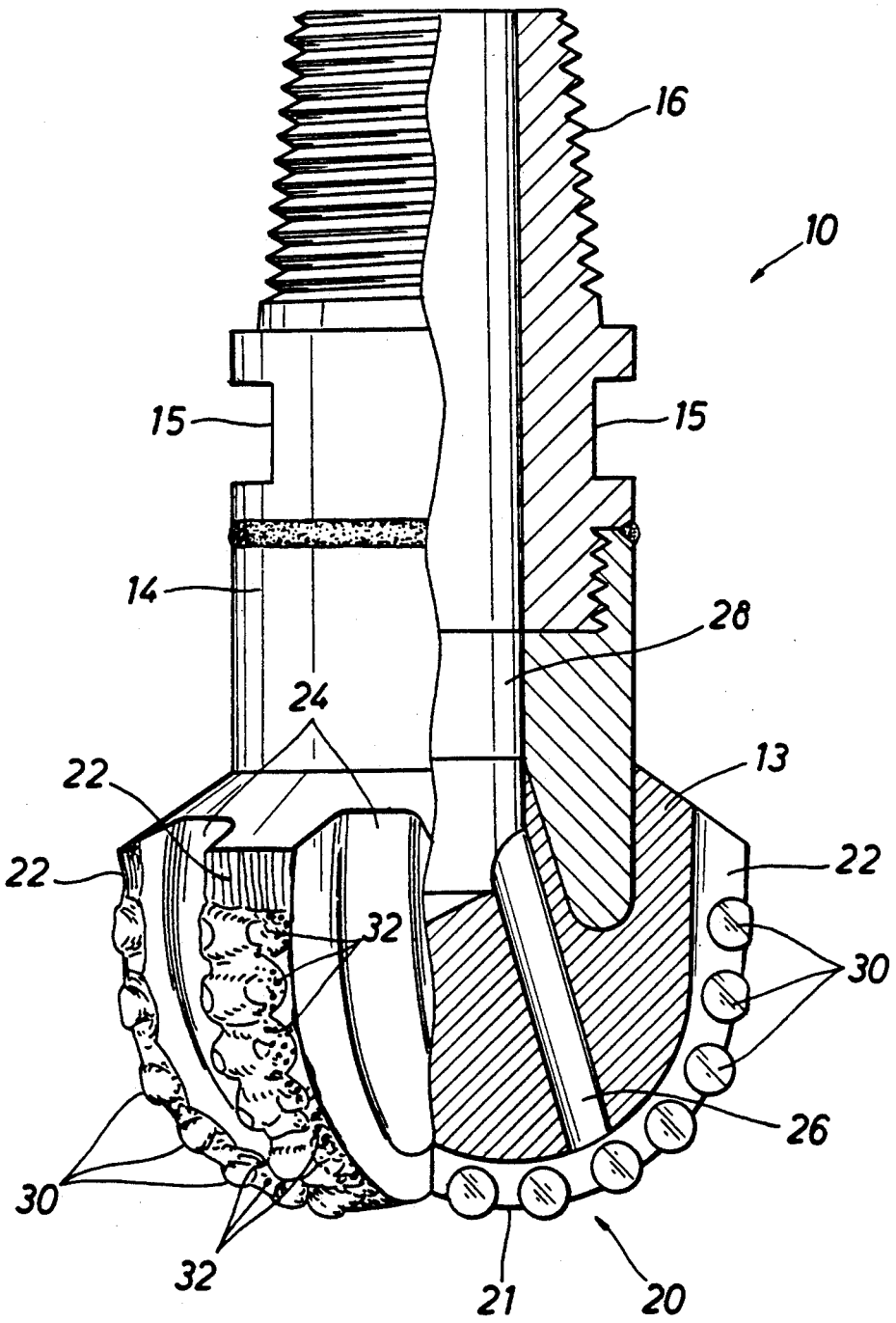
FIG. 1 is a partial vertical cross-section of the preferred embodiment of the present invention, illustrating polycrystalline diamond cutters (PDC) mounted on radial raised ribs on the tungsten carbide matrix bit drilling head with flat diamond pieces mounted rearward of the PDC cutters.

Turning now to FIG. 1, the diamond drag bit generally designated as 10, consists of a bit body 12, shank 14, pin end 16 and a cutting end generally designated as 20. The cutting end 20 is fabricated from tungsten carbide matrix 13 by methods well known to those skilled in the art of powdered metallurgy. A pair of wrench flats 15 are formed in the shank portion 14 of bit 10. The wrench flats are designed to accommodate a bit breaker (not shown), used to connect and disconnect pin end 16 from a drillstring (not shown).

Figure 2:
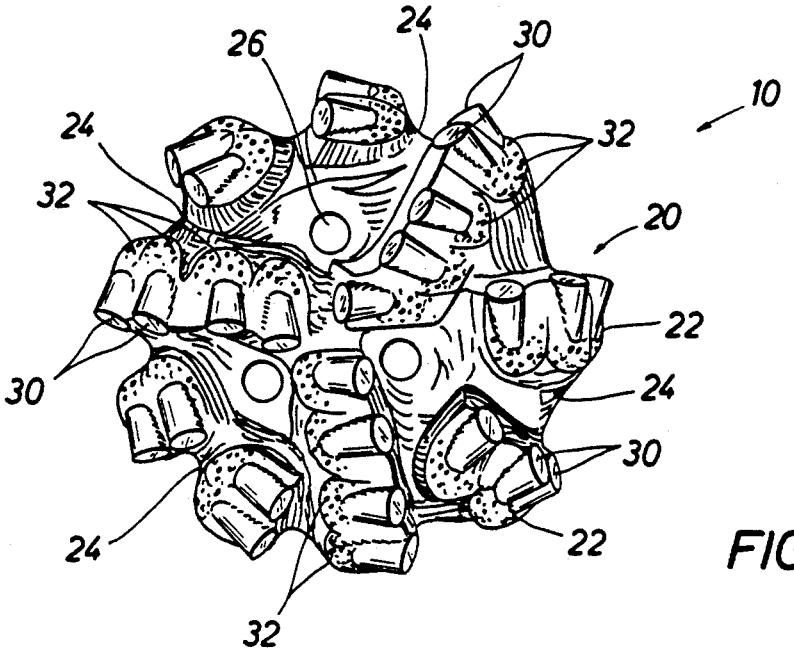
FIG. 2 is a face view of the aforementioned matrix bit drilling head clearly illustrating the raised radial ribs with the PDC cutters mounted thereon and drilling fluid channels formed between the ribs. Fluid exit ports feeding the fluid channels are also shown. Protective flat diamond particles are depicted rearward of the PDC cutter imbedded in the tungsten carbide rib.

The cutting end 20, as shown in FIG. 2, consists of a series of essentially radial raised ribs or lands 22 formed on the face 21 of the cutting end 20. The drilling fluid is discharged through nozzles 26 to the radial fluid channels 24 formed across the bit face 21 and up the hole annulus (not shown).

A multiplicity of polycrystalline diamond cutters (PDC) 30 are fixedly attached in strategic locations on the outer faces of the raised radial rib sections 22. These cutters 30 are positioned with appropriate back-rake and side-rake angles. Flat natural diamond pieces or segments 32 are the preferred material to be imbedded in the tungsten carbide matrix 13, flush with the outer surface of the raised ribs 22, rearward of and somewhat lateral to the PDC cutters 30 with all pieces over-lapping to cover essentially all of the rib trailing surface.

Other flat ultra-hard pieces of material such as thermally stable polycrystalline diamond (TSP), cubic boron nitride (CBN), cermets or ceramics may be used as described above in certain applications and still remain within the scope of the present invention.

Figure 3:
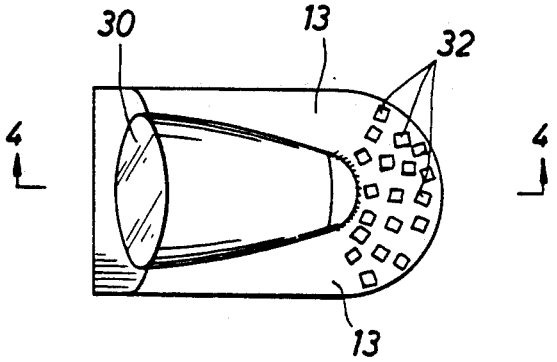
FIG. 3 is a top view of a single cylinder type PDC cutter mounted on a raised rib on the bit cutting head, with flush mounted flat diamond pieces imbedded in the tungsten carbide matrix rearward of the PDC cutter.
Figure 4:
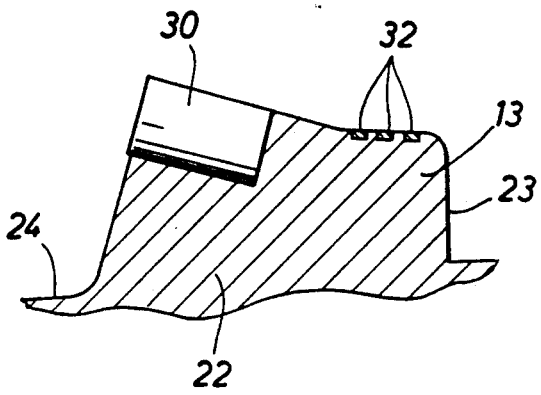
FIG. 4 shows a cross-section 4—4 in FIG. 3 which is parallel to the axis of the cylindrical PDC cutter. Flat sided diamond pieces 32 are shown imbedded in the tungsten carbide matrix rib section.

FIG. 4 is cross-section 4—4 of FIG. 3 showing a cylindrical PDC cutter 30 rigidly affixed in cutter socket 31. Also shown are the flat sided diamond pieces 32 imbedded in the tungsten carbide matrix rib 22 flush with the outer surface of the rib 22. These diamond pieces 32 shown are directly rearward of the PDC cutter 30.

Other types of cutters 32 rather than cylinder types PDC may be used for the present invention. These may be vertical stud type PDC cutters or others of different material or geometry.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A diamond drag bit for drilling a borehole in an earthen formation, said drag bit comprising;

a bit body forming a first open pin end adapted to be connected to a drill string and a second cutter end, said bit body forming a plenum chamber therein for receiving a source of drilling fluid transported through said drill string, one or more nozzles being formed by said cutter end of said body communicates with said plenum chamber and directs said fluid from said chamber to said borehole, a face of said second cutter end forming a plurality of radially extended ribbed portions and valleys between said ribbed portions, a portion of said fluid being directed through said valleys and over said ribbed portions during operation of said drag bit in said borehole, a multiplicity of diamond cutters are strategically positioned and fixedly attached on a first outer leading edge face of said raised rib portions, said cutters being retained in preformed sockets formed in said first leading edge face of the raised rib portions, and a multiplicity of ultra-hard material segments having at least one flat surface are imbedded in a second outer surface formed by said raised rib portion, said segments of hard material are strategically positioned both rearwardly and laterally of each of said diamond cutters fixedly attached on said first outer leading edge face, each of said segments being fixedly secured with their flat surface substantially flush with said second outer surface formed by said raised rib portion, said multiplicity of ultra-hard material segments serve to protect a third trailing edge surface formed by said raised ribs behind said diamond cutters from abrading thereby minimizing cutter loss.

2. The invention as set forth in claim 1 wherein said diamond cutters are polycrystalline diamond cutters mounted to tungsten carbide studs.

3. The invention as set forth in claim 2 wherein said diamond cutters mounted to tungsten carbide studs are cylindrical in shape.

4. The invention as set forth in claim 1 wherein said ultra-hard material is thermally stable polycrystalline diamond with at least one flat surface formed thereon.

5. The invention as set forth in claim 1 wherein said second cutter end of said drag bit is formed of a tungsten carbide matrix, said ultra-hard segments being metallurgically secured within the second outer surface formed by said raised rib portion.

6. A method of protecting each of a multiplicity of diamond cutters strategically positioned and secured within preformed sockets formed in a first leading edge face of a plurality of radially disposed raised rib portions formed in a cutting end of a diamond drag bit comprising the steps of:

securing a multiplicity of ultra-hard material segments having at least one flat surface thereon in a second outer surface formed by said raised rib portion, each of said segments being strategically positioned both rearwardly and laterally of each of said diamond cutters secured within said first leading edge face of said rib, each of said segments being fixedly secured with their flat surface substantially flush with said second outer surface of said raised rib portion, said multiplicity of ultra-hard material segments serve to protect a third trailing edge surface formed by said raised ribs behind said diamond cutters from abrading thereby minimizing cutter loss.

7. The method as set forth in claim 6 further comprising the steps of forming the cutter end of said drag bit from a matrix of tungsten carbide, said multiplicity of ultra-hard segments being secured in said matrix with their flat portions flush with said second surface formed by said raised rib portion of said matrix.

8. The method as set forth in claim 7 wherein said ultra-hard segments are fabricated from thermally stable polycrystalline diamond material.

* * * * *